US007517072B2

(12) United States Patent
Jones et al.

(10) Patent No.: US 7,517,072 B2
(45) Date of Patent: Apr. 14, 2009

(54) SOLID INK STICK WITH ENHANCED DIFFERENTIATION

(75) Inventors: Brent Rodney Jones, Sherwood, OR (US); Darrell Ray Finneman, Albany, OR (US)

(73) Assignee: Xerox Corporation, Norwalk, CT (US)

( * ) Notice: Subject to any disclaimer, the term of this patent is extended or adjusted under 35 U.S.C. 154(b) by 420 days.

(21) Appl. No.: 11/473,611

(22) Filed: Jun. 23, 2006

(65) Prior Publication Data

US 2007/0296781 A1 Dec. 27, 2007

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS

| | | | | |
|---|---|---|---|---|
| 5,223,860 | A | 6/1993 | Loofbourow et al. | |
| 5,442,387 | A | 8/1995 | Loofbourow et al. | |
| 5,734,402 | A * | 3/1998 | Rousseau et al. | 347/88 |
| 5,861,903 | A * | 1/1999 | Crawford et al. | 347/88 |
| 5,975,688 | A | 11/1999 | Kanaya et al. | |
| 6,056,394 | A | 5/2000 | Rousseau et al. | |
| 6,213,600 | B1 | 4/2001 | Kobayashi et al. | |
| 6,761,443 | B2 | 7/2004 | Jones | |
| 6,840,613 | B2 | 1/2005 | Jones | |
| 2003/0038851 | A1 * | 2/2003 | Oriol | 347/14 |

FOREIGN PATENT DOCUMENTS

| | | |
|---|---|---|
| EP | 1359014 A1 | 11/2003 |
| EP | 1359015 A1 | 11/2003 |
| EP | 1359024 A1 | 11/2003 |
| EP | 1731315 A1 | 12/2006 |

* cited by examiner

*Primary Examiner*—Stephen D Meier
*Assistant Examiner*—Alexander C Witkowski
(74) *Attorney, Agent, or Firm*—Maginot, Moore & Beck LLP

(57) ABSTRACT

An ink stick for use in a phase change ink imaging device is provided. The ink stick comprises a three dimensional ink stick body having an exterior surface. Two or more interface tracks are formed in the exterior surface of the ink stick parallel to a feed direction of an ink loader. Each interface track includes one or more actuation portions for actuating one or more sensors in the feed channel. The ink mass of the ink stick body may be substantially the same between actuation portions of a first interface track. A second interface track includes at lease one predetermined characteristic corresponding to a distance between an actuation portion of the second interface track and another feature of the ink stick, the predetermined characteristic being sized to correspond to variable control information pertaining to an ink stick.

26 Claims, 10 Drawing Sheets

| | PAGE PACK | COLOR | EUROPEAN COLOR | ASIAN COLOR | THERMAL SETTINGS |
|---|---|---|---|---|---|
| DIMENSION A | X | | | | |
| DIMENSION B | | | | | X |
| ANGLE ONE | | X | | | |
| ANGLE TWO | | | X | | |
| ANGLE THREE | | | | X | |

FIG. 12

SOLID INK STICK WITH ENHANCED DIFFERENTIATION

CROSS-REFERENCE TO RELATED APPLICATIONS

Reference is made to commonly-assigned copending U.S. patent applications Ser. No. 11/473,610, entitled "Ink Loader for Interfacing with Solid Ink Sticks" and Ser. No. 11/473,632, entitled "Solid Ink Stick with Interface Element" and Ser. No. 11/473,656, entitled "Solid Ink Stick with Coded Sensor Feature" all of which are filed concurrently herewith, the entire disclosures of which are expressly incorporated by reference herein.

TECHNICAL FIELD

This disclosure relates generally to phase change ink jet printers, the solid ink sticks used in such ink jet printers, and the load and feed apparatus for feeding the solid ink sticks within such ink jet printers.

BACKGROUND

Solid ink or phase change ink printers conventionally use ink in a solid form, either as pellets or as ink sticks of colored cyan, yellow, magenta and black ink fed into shape coded openings. These openings fed generally vertically into the heater assembly of the printer where they were melted into a liquid state for jetting onto the receiving medium. The pellets were fed generally vertically downwardly, using gravity feed, into the ink loader. These pellets were elongated with separate multisided shapes each corresponding to a particular color.

Solid ink sticks have been typically either gravity fed or spring loaded into a feed channel and pressed against a heater plate to melt the solid ink into its liquid form. These ink sticks were shape coded and of a generally small size. One system used an ink stick loading system that initially fed the ink sticks into a preload chamber and then loaded the sticks into a load chamber by the action of a transfer lever. Earlier solid or hot melt ink systems used either a flexible web of hot melt ink that was incrementally unwound and advanced to a heater location or particulate hot melt ink that was delivered by vibrating the particulate into the melt chamber.

In previously known phase change ink jet printing systems, the interface between a control system for a phase change ink jet printer and a solid ink stick provided little information about the solid ink sticks loaded in the printer. For instance, previously known control systems are unable to determine accurately the amount of ink ejected from the printhead of the printer. Once ink has been melted and reaches the print head of a printer, the liquid ink flows through manifolds to be ejected from microscopic orifices by piezoelectric transducers (PZT). An electric pulse is applied to the PZTs to cause droplets of ink to be ejected from the orifices. The duration and amplitude of the electrical pulse applied to the PZTs is controlled so that a consistent volume of ink may be ejected by each orifice. Thus, the total amount of ink that has been "theoretically" used may be calculated by counting the number of times ink has been ejected from the PZTs and multiplying that number by the amount of ink that should have been ejected during each pulse. The amount of ink ejected from the PZTs may vary or drift over time due to a number of factors, such as, for example, prolonged use. Previously known control systems are generally not able to determine accurately the amount of drift occurring in the volume of ink ejected from the printhead.

As another example, previously known control systems are typically only able to sense when the first color (of the four colors) of solid ink in an ink loader reaches a "low" volume state or an "out of ink" state. Additionally, these control systems are generally not able to determine which of the colors caused the "low" or "out of ink" state or the fill status of the other colors of solid ink that have not caused the "low" or "out of ink" state.

Moreover, previously known control systems are limited in their ability to gain specific information about an ink stick that is currently loaded in the feed channels. For instance, control systems are not able to determine if the correct color of ink stick is loaded in a particular feed channel or if the ink that is loaded is compatible with that particular printer. Provisions have been made to ensure that an ink stick is correctly loaded into the intended feed channel and to ensure that the ink stick is compatible with that printer. These provisions, however, are generally directed toward excluding wrong colored or incompatible ink sticks from being inserted into the feed channels of the printer. For example, the correct loading of ink sticks has been accomplished by incorporating keying, alignment and orientation features into the exterior surface of an ink stick. These features are protuberances or indentations that are located in different positions on an ink stick. Corresponding keys or guide elements on the perimeters of the openings through which the ink sticks are inserted or fed exclude ink sticks which do not have the appropriate perimeter key elements while ensuring that the ink stick is properly aligned and oriented in the feed channel.

While this method is effective in ensuring correct loading of ink sticks in most situations, there are still situations when an ink stick may be incorrectly loaded into a feed channel of a printer. For example, world markets with various pricing and color table preferences have created a situation where multiple ink types may exist in the market simultaneously with nearly identical size/shape ink and/or ink packaging. Thus, ink sticks may appear to be substantially the same but, in fact, may be intended for different phase change printing systems due to factors such as, for example, market pricing or color table. In addition, due to the soft, waxy nature of an ink stick body, an ink stick may be "forced" through an opening into a feed channel. The printer control system, having no information regarding the configuration of the ink stick, may then conduct normal printing operations with an incorrectly loaded ink stick. If the loaded ink stick is the wrong color for a particular feed channel or if the ink stick is incompatible with the phase change ink jet printer in which it is being used, considerable errors and malfunctions may occur.

SUMMARY

Improvement in the operation of a phase change ink imaging device is obtained with an ink stick having interface tracks for storing data about the ink stick that may be used by the controller of the imaging device. The ink stick comprises a three dimensional ink stick body having an exterior surface. Two or more interface tracks are formed in the exterior surface of the ink stick parallel to a feed direction of an ink loader. Each interface track includes one or more actuation portions for actuating one or more sensors in the feed channel. The ink mass of the ink stick body is substantially the same between actuation portions of a first interface track. A second interface track includes at lease one predetermined characteristic corresponding to a distance between an actuation portion of the second interface track and another feature of the ink stick, the predetermined characteristic being sized to correspond to variable control information pertaining to an ink stick. A reference signal is generated that corresponds to the predetermined characteristic. An imaging device control system receives the reference signal and then may translate the reference signal into control information pertaining to the ink stick.

In one embodiment, the predetermined characteristic comprises an actuation distance, the actuation distance corresponding to a distance between actuation portions of the second interface track. In another embodiment, the predetermined characteristic comprises a phase difference of the second interface track, the phase difference corresponding to a distance between a first actuation portion of the first interface track and the next successive actuation portion of the second interface track. Control information may be encoded into the predetermined characteristic by pre-selecting the size of the predetermined characteristic to correspond to the control information pertaining to the ink stick.

In another embodiment, a solid ink loader for use with a phase change imaging device is provided. The ink loader comprises a push block for contacting and urging an ink stick along a feed channel; a first sensor for detecting actuation portions of a first interface track of an ink stick and generating a first signal in response to the detecting of the actuation portions; a second sensor for sensing actuation portions of a second interface track of an ink stick and generating a second signal in response to the detecting of the actuation portions; and a distance sensor for measuring a longitudinal distance along an ink stick body in the feed channel.

In yet another embodiment, a method of feeding ink sticks is provided. The method comprises inserting one or more ink sticks into a feed channel of a phase change imaging device and urging the one or more ink sticks along the feed channel toward the melt end of the feed channel. As the ink sticks are being urged along the feed channel, a first signal is generated in response to detecting actuation portions of a first interface track of the one or more ink sticks in the feed channel as the actuation portions pass a first sensor in the feed channel. The first signal indicates to a printer control system that a predetermined amount of ink mass has been consumed. A second signal is generated in response to detecting actuation portions of a second interface track of the one or more ink sticks in the feed channel as the actuation portions pass a second sensor in the feed channel. A distance the one or more ink sticks have been urged along the feed channel between generations of the first or second signals is then determined. The distance may correspond to variable control information pertaining to the one or more ink sticks in the feed channel. The distance of travel referred to is directly related to the mass of ink being melted for a given ink stick configuration where this correlation is established and programmed into a controller of the imaging device. The number and placement of sensor tracks and the number of transition features within each track can encompass the range of possibilities that are practical based on ink size, feature size and information content within a specific sensor scheme.

BRIEF DESCRIPTION OF THE DRAWINGS

FIG. 12 is an example attribute array of information that may be provided by an ink stick.

DETAILED DESCRIPTION OF THE PREFERRED EMBODIMENT

Figure 1:
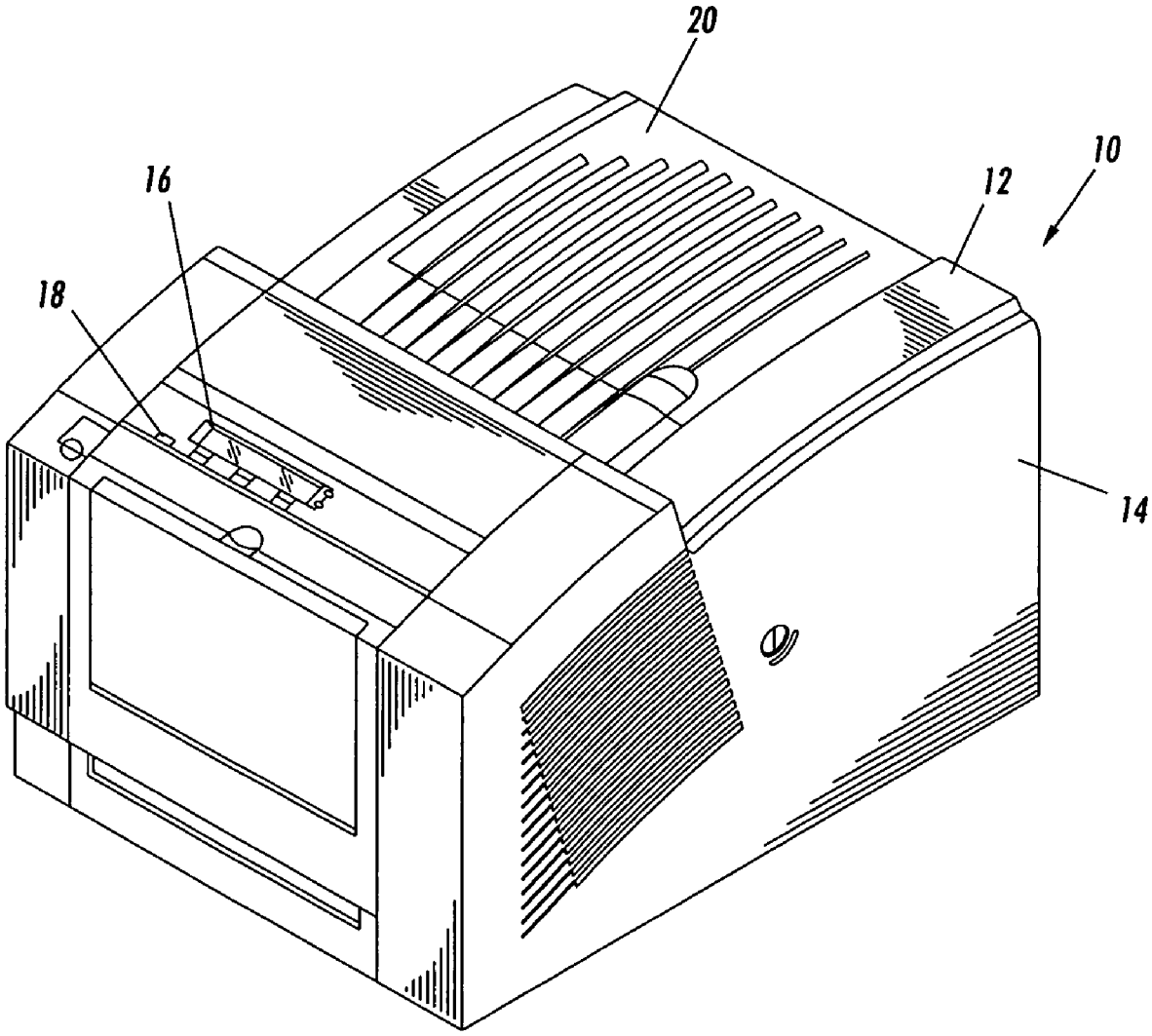
FIG. 1 is a perspective view of a phase change printer with the printer top cover closed.

For a general understanding of the present embodiments, reference is made to the drawings. In the drawings, like reference numerals have been used throughout to designate like elements.

FIG. 1 shows a solid ink, or phase change, ink printer 10 that includes an outer housing having a top surface 12 and side surfaces 14. A user interface, such as a front panel display screen 16, displays information concerning the status of the printer, and user instructions. Buttons 18 or other control elements for controlling operation of the printer are adjacent the front panel display screen, or may be at other locations on the printer. An ink jet printing mechanism (not shown) is contained inside the housing. An example of the printing mechanism is described in U.S. Pat. No. 5,805,191, entitled Surface Application System, to Jones et al., and U.S. Pat. No. 5,455,604, entitled Ink Jet Printer Architecture and Method, to Adams et al. An ink loader 100 delivers ink to the printing mechanism. The ink loader 100 is contained under the top surface of the printer housing. The top surface of the housing includes a hinged ink access cover 20 that opens as shown in FIG. 2, to provide the operator access to the ink loader 100.

Figure 2:
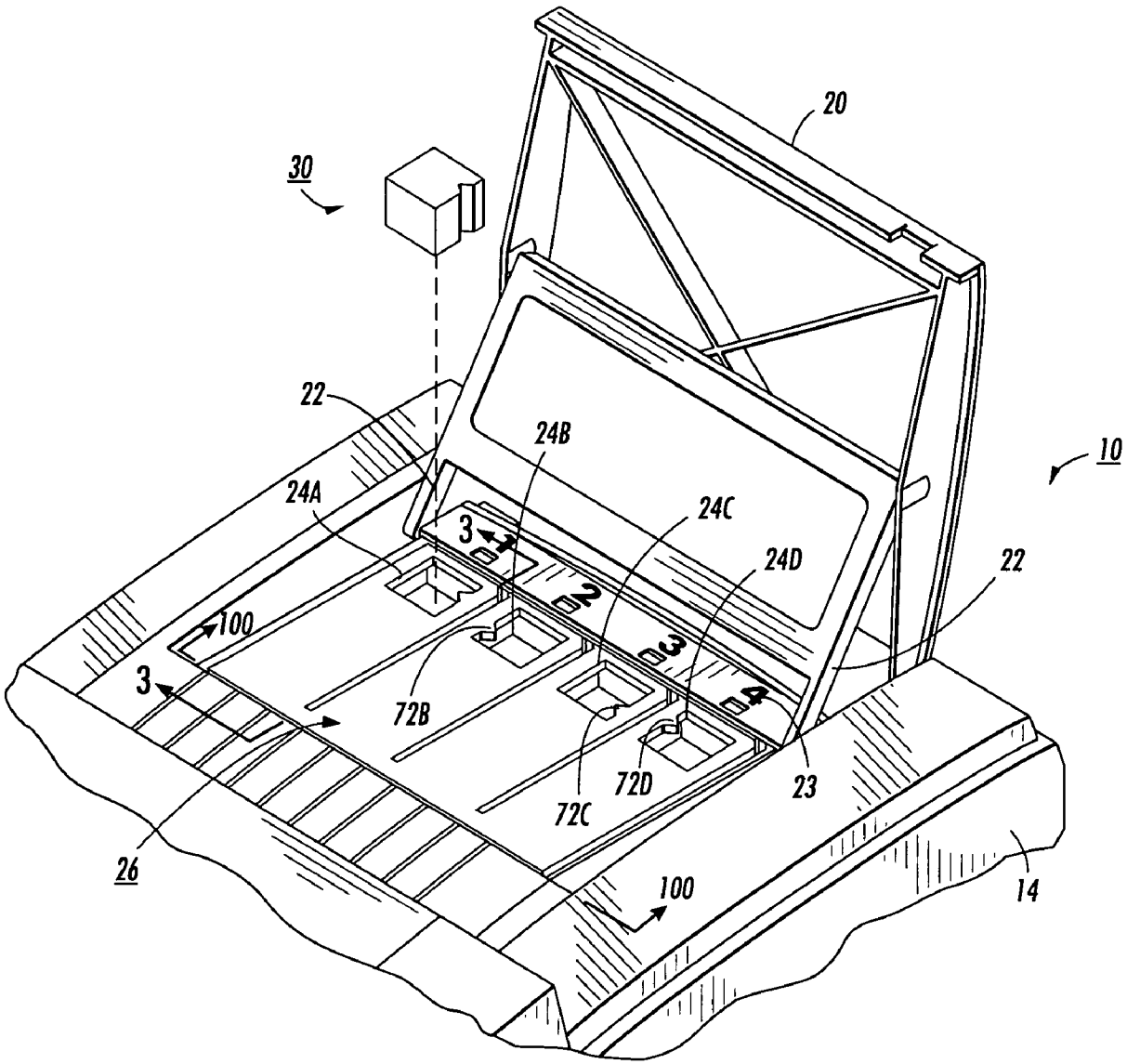
FIG. 2 is an enlarged partial top perspective view of the phase change printer with the ink access cover open, showing a solid ink stick in position to be loaded into a feed channel.
Figure 3:
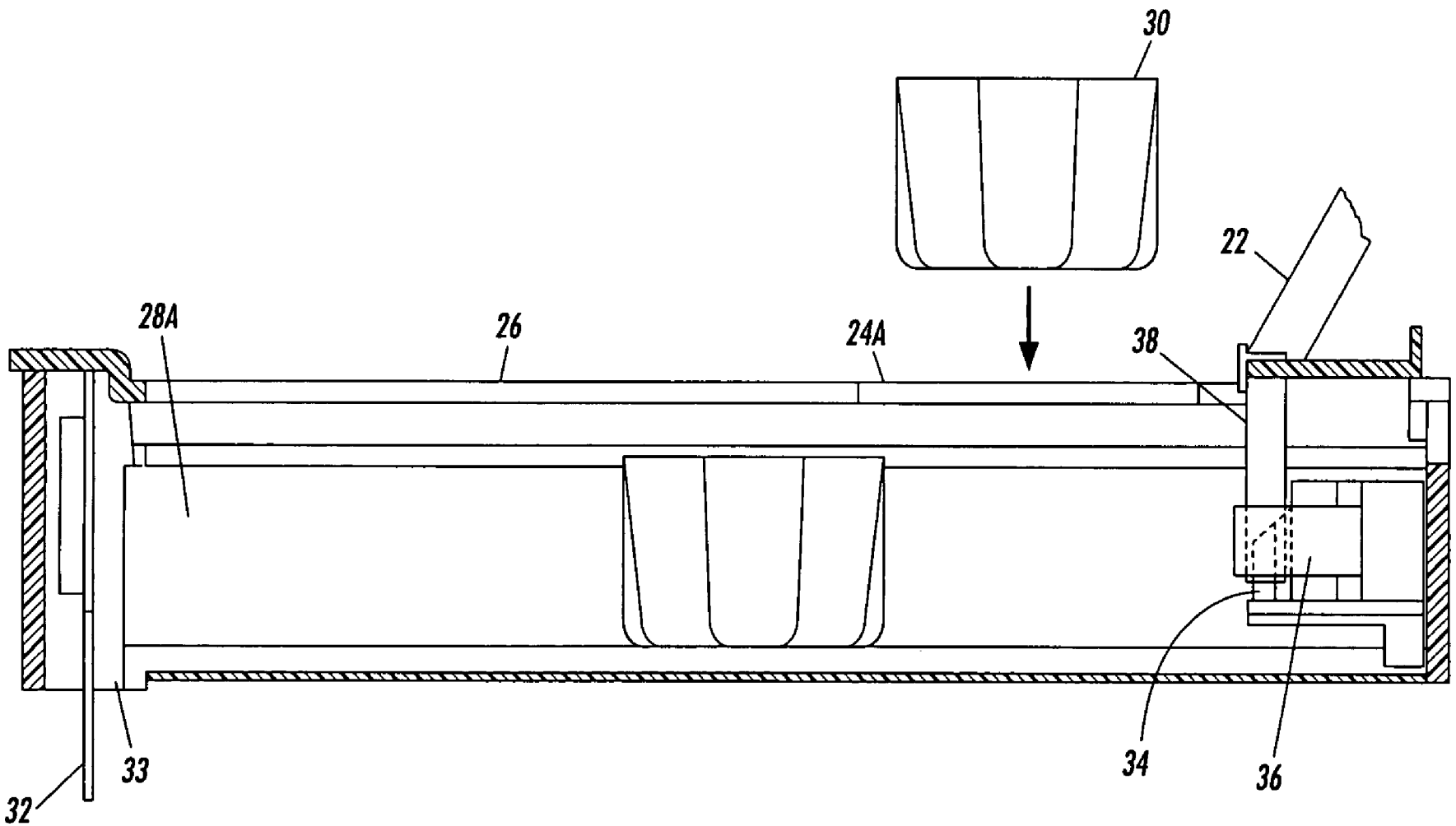
FIG. 3 is a side sectional view of a feed channel of a solid ink feed system taken along line 3-3 of FIG. 2.

FIG. 2 illustrates the printer 10 with its ink access cover 20 raised revealing an ink load linkage element 22 and an ink stick feed assembly or ink loader 100. In the particular printer shown, the ink access cover 20 is attached to an ink load linkage element 22 so that when the printer ink access cover 20 is raised, the ink load linkage 22 slides and pivots to an ink load position. The interaction of the ink access cover and the ink load linkage element is described in U.S. Pat. No. 5,861,903 for an Ink Feed System, issued Jan. 19, 1999 to Crawford et al. As seen in FIG. 2, the ink loader includes a key plate 26 having keyed openings 24. Each keyed opening 24A, 24B, 24C, 24D provides access to an insertion end of one of several individual feed channels 28A, 28B, 28C, 28D of the ink loader (see FIG. 3).

Each longitudinal feed channel 28 of the ink loader 100 delivers ink sticks 30 of one particular color to a corresponding melt plate 32. Each feed channel has a longitudinal feed direction from the insertion end of the feed channel to the melt end of the feed channel. The melt end of the feed channel is adjacent the melt plate. The melt plate melts the solid ink stick into a liquid form. The melted ink drips through a gap 33 between the melt end of the feed channel and the melt plate, and into a liquid ink reservoir (not shown). The feed channels 28A, 28B, 28C, 28D (see FIG. 3) have a longitudinal dimension from the insertion end to the melt end, and a lateral dimension, substantially perpendicular to the longitudinal dimension.

Each feed channel 28 in the particular embodiment illustrated includes a push block 34 driven by a driving force or element, such as a constant force spring 36 to push the individual ink sticks along the length of the longitudinal feed channel toward the melt plates 32 that are at the melt end of each feed channel. The tension of the constant force spring 36 drives the push block 34 toward the melt end of the feed channel. In a manner similar to that described in U.S. Pat. No. 5,861,903, the ink load linkage 22 is coupled to a yoke 38, which is attached to the constant force spring mounted in the push block. The attachment to the ink load linkage 22 pulls the push block 34 toward the insertion end of the feed channel when the ink access cover is raised to reveal the key plate 26. In the implementation illustrated, the constant force spring 36 can be a flat spring with its face oriented along a substantially vertical axis.

A color printer typically uses four colors of ink (yellow, cyan, magenta, and black). Ink sticks 30 of each color are delivered through a corresponding individual one of the feed channels 28A, 28B, 28C, 28D. The operator of the printer exercises care to avoid inserting ink sticks of one color into a feed channel for a different color. Ink sticks may be so saturated with color dye that it may be difficult for a printer operator to tell by the apparent color alone which color is which. Cyan, magenta, and black ink sticks in particular can be difficult to distinguish visually based on color appearance. The key plate 26 has keyed openings 24A, 24B, 24C, 24D to aid the printer operator in ensuring that only ink sticks of the proper color are inserted into each feed channel. Each keyed opening 24A, 24B, 24C, 24D of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel.

Figure 4:
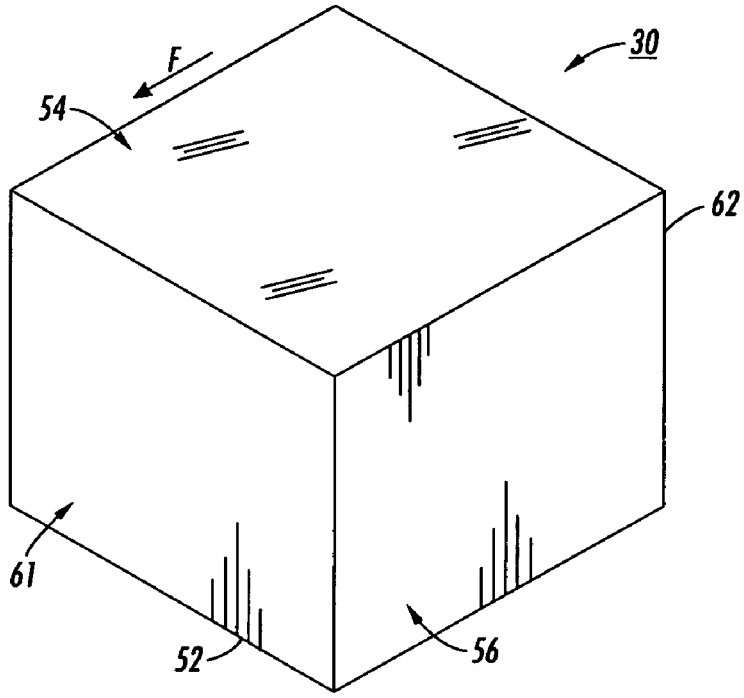
FIG. 4 is a perspective view of one embodiment of a solid ink stick.

An exemplary solid ink stick 30 for use in the ink loader is illustrated in FIG. 4. The ink stick 30 is shown without any special features for clarity. The ink stick is formed of a three dimensional ink stick body. The ink stick body illustrated has a bottom exemplified by a generally bottom surface 52 and a top exemplified by a generally top surface 54. The particular bottom surface 52 and top surface 54 illustrated are substantially parallel one another, although they can take on other contours and relative relationships. The surfaces of the ink stick body need not be flat, nor need they be parallel or perpendicular one another. However, these descriptions will aid the reader in visualizing, even though the surfaces may have three dimensional topography, or be angled with respect to one another. The ink stick body also has a plurality of side extremities, such as side surfaces 56 and end surfaces 61, 62. The illustrated embodiment includes four side surfaces, including two end surfaces 61, 62 and two lateral, side surfaces 56. The basic elements of the lateral side surfaces 56 are substantially parallel one another, and are substantially perpendicular to the top and bottom surfaces 52, 54. The end surfaces 61, 62 are also basically substantially parallel one another, and substantially perpendicular to the top and bottom surfaces, and to the lateral side surfaces. One of the end surfaces 61 is a leading end surface, and the other end surface 62 is a trailing end surface. The ink stick body may be formed by pour molding, injection molding, compression molding, or other known techniques.

An ink stick includes at least two interface tracks 70, 74 for interfacing with an appropriately equipped ink loader 100 to convey variable control information to an imaging device control system. In particular, a first interface track 70 is configured to convey ink mass consumption information to the control system. One or more additional interface tracks 74 may be configured to convey additional variable control information to the control system pertaining to the ink stick. The ink loader 100 may include a sensor system (explained in more detail below) designed to interface with the two or more interface tracks 70, 74 to generate reference signals that correspond to the control information to be conveyed by the interface tracks.

Referring to FIGS. 5-9, each interface track forms a path parallel to the feed direction that extends at least partially from the leading end 61 to the trailing end 62 of an ink stick. One or more sensor actuation portions 78 may be formed along each interface track for actuating one or more sensors (not shown) of the sensor system in a feed channel of an ink loader. Each interface track 70, 74 may be beneficially formed in a location on the exterior surface of an ink stick where handling damage cannot easily influence sensor interface with the ink loader. Thus, an interface track may be formed in an inner surface of an inset feature formed in the exterior surface of an ink stick such as, for example, a recess, notch, step, slot, "V", or similar feature. The interface track may be formed in any surface of an inset feature that allows the actuation portions to be sensed or detected by a suitable sensor in the ink loader. For example, in FIGS. 5-9, the interface track is formed in a lateral surface of a recess.

Figure 7:
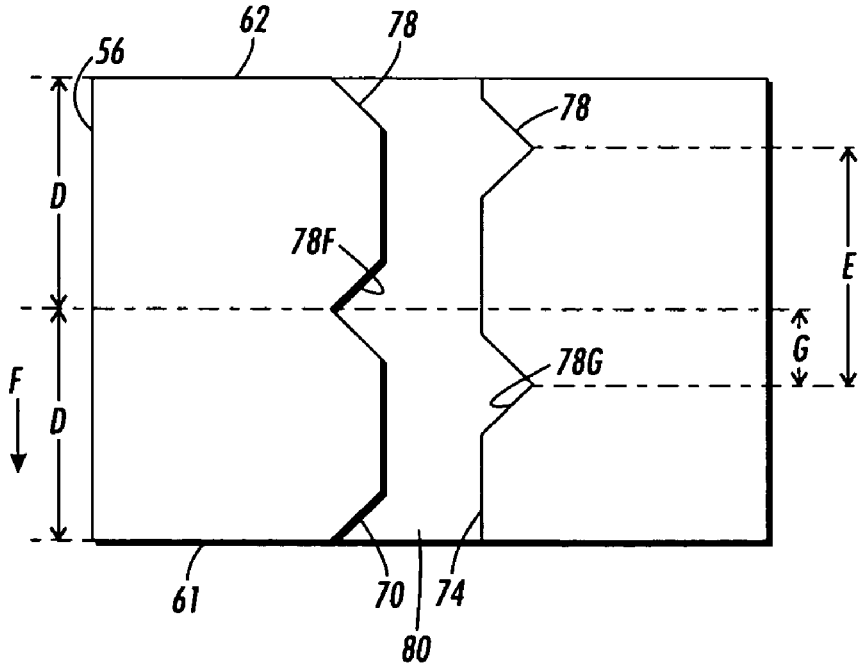
FIG. 7 is a bottom view of another embodiment of an ink stick.
Figure 8:
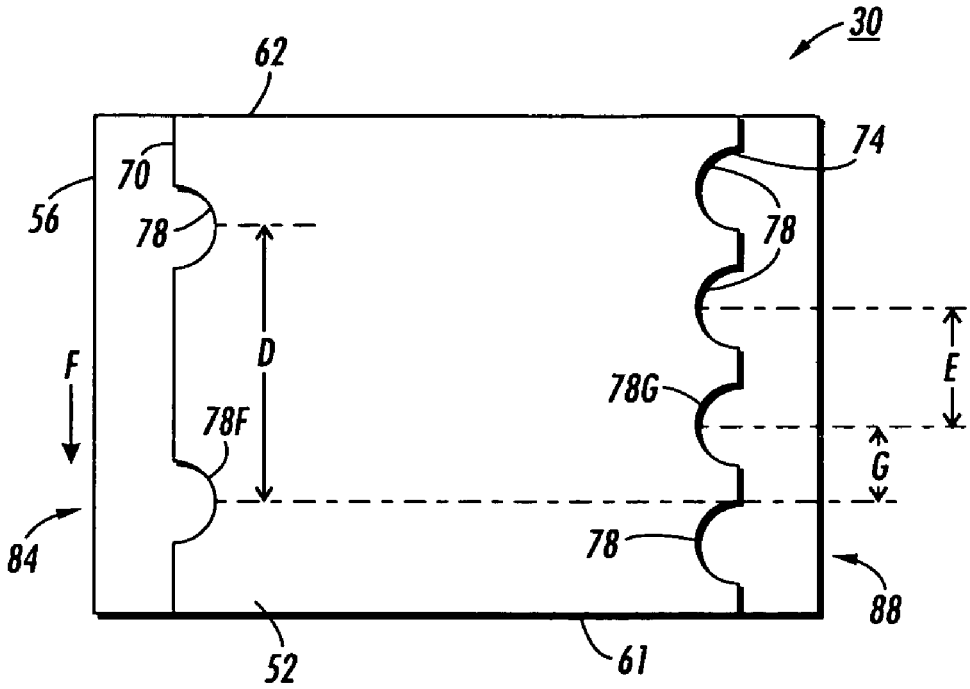
FIG. 8 is a bottom view of another embodiment of an ink stick.
Figure 9:
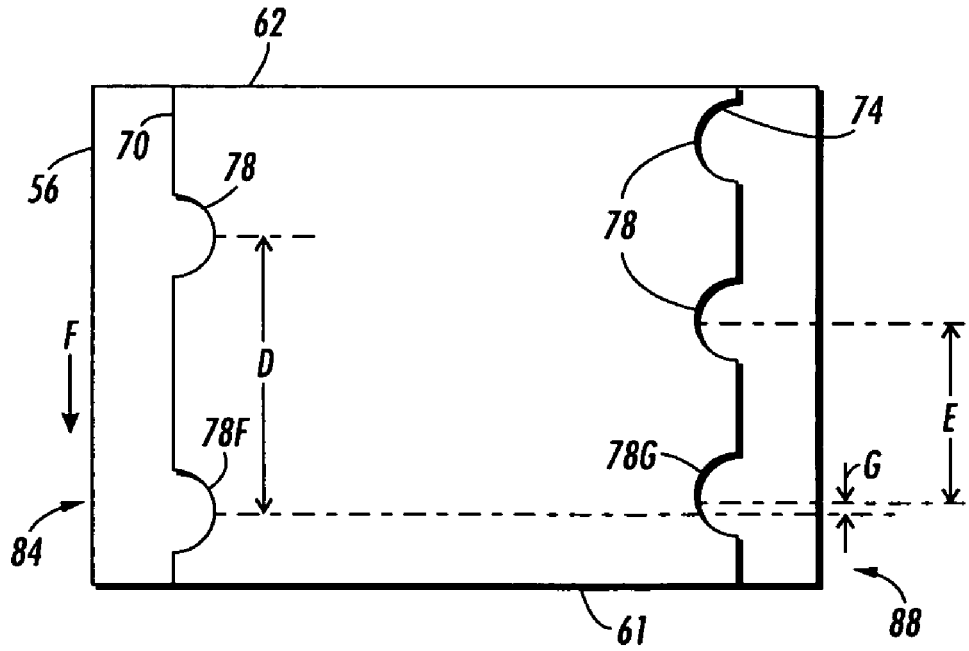
FIG. 9 is a bottom view of another embodiment of an ink stick.

More than one interface track may be formed in a single inset feature. For example, the ink stick of FIGS. 5-7 includes a recess 80. An interface track 70, 74 is formed in each lateral side of the recess. Additionally, interface tracks 70, 74 may be formed in a plurality of inset features on an ink stick. FIGS. 8 and 9 depict two inset features formed as steps 84, 88 on lateral sides of the ink stick where the bottom surface and the lateral sides meet. Each of the steps 84, 88 includes an interface track 70, 74. Thus, the number of interface tracks that may be formed into an ink stick is only limited by the geometry of the ink sticks and sensor placement options in an ink loader.

The actuation portions 78 of the interface tracks may be curved, spherical, angled, square or any shape that permits reliable sensor actuation, directly or indirectly, such as by moving a flag or actuator or using an optical sense system. For example, the actuation portions of the interface tracks in FIGS. 5-7 comprise insets having angled surfaces. The actuation portions of the interface tracks of FIGS. 8 and 9 are insets having a curved surface. The actuation portions of the first and additional interface tracks need not be of the same type.

Referring again to FIG. 5, as mentioned above, the first interface track 70 is configured to interface with the sensor system of an ink loader to generate a reference signal that corresponds to ink consumption information. In this embodiment, the first interface track 70 is formed in a lateral side of a recess in the bottom surface 52 of the ink stick that extends from the leading end 61 to the trailing end 62 parallel to the feed direction F. The first interface track 70 includes a plurality of spaced actuation portions 78 formed along the length of the interface track 70 with the ink mass between each actuation portion 78 being substantially the same. Thus, the spacing of the actuation portions 78 may be slightly variable to accommodate changes in mass along a shaped ink stick. The individual actuation portions 78 may be detected by a sensor system in the ink loader (not shown). The actuation portions may be detected optically, although any suitable detection method may be used. The spaced positioning of the actuation portions along the length of the interface track 70 enables a determination of the approximate amount of an ink stick that has been consumed between any two or more of the actuation portions. For instance, in the case of an interface track comprising two evenly spaced actuation portions, as shown in FIG. 8, the control system may be programmed with data that one half of an ink stick has been consumed with each generation of the reference signal.

A benefit of determining actual ink mass consumption is optimization of print head functioning. As described above, once ink has been melted and reaches the print head of a printer, the liquid ink flows through manifolds to be ejected from microscopic orifices through use of piezoelectric transducer (PZT) print head technology. An electric pulse is applied to the PZT thereby causing droplets of ink to be ejected from the orifices. The duration and amplitude of the electrical pulse applied to the PZT is controlled so that a consistent volume of ink may be ejected by each orifice. Thus, the total amount of ink that has been "theoretically" used may be calculated by counting the number of times ink has been ejected from the PZT and multiplying that by the amount of ink that should have been ejected during each pulse. The amount of ink ejected from the PZT may vary or drift over time due to a number of factors, such as, for example, prolonged use. By comparing the rate of ink mass passing the sensor to theoretical ink mass consumed during imaging, the amount of drift of the quantity ink ejected from the PZT may be determined. The amplitude or duration of the electric pulse may then be calibrated to correct the drift so that the amount of ink ejected by the PZT may be optimized.

Figure 10:
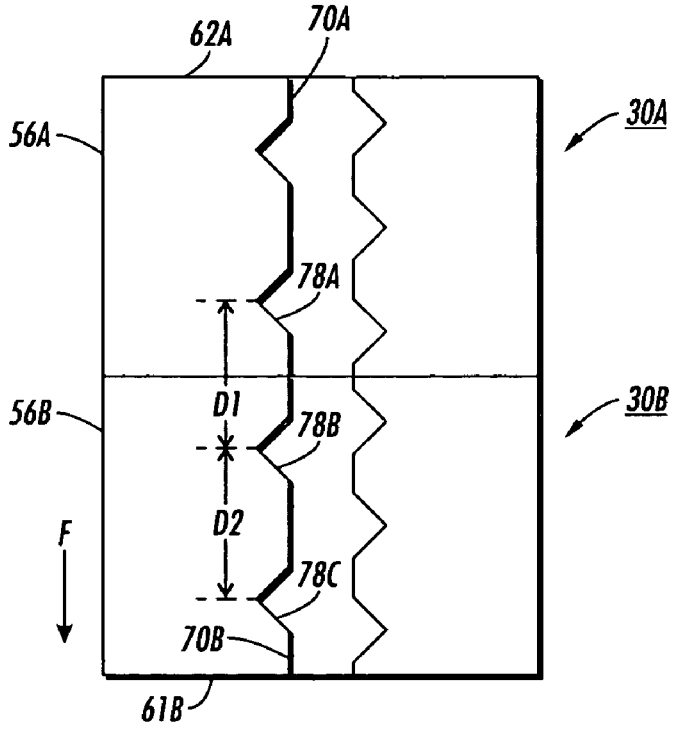
FIG. 10 is a bottom view of an ink stick abutting another ink stick in a feed channel.
Figure 11:
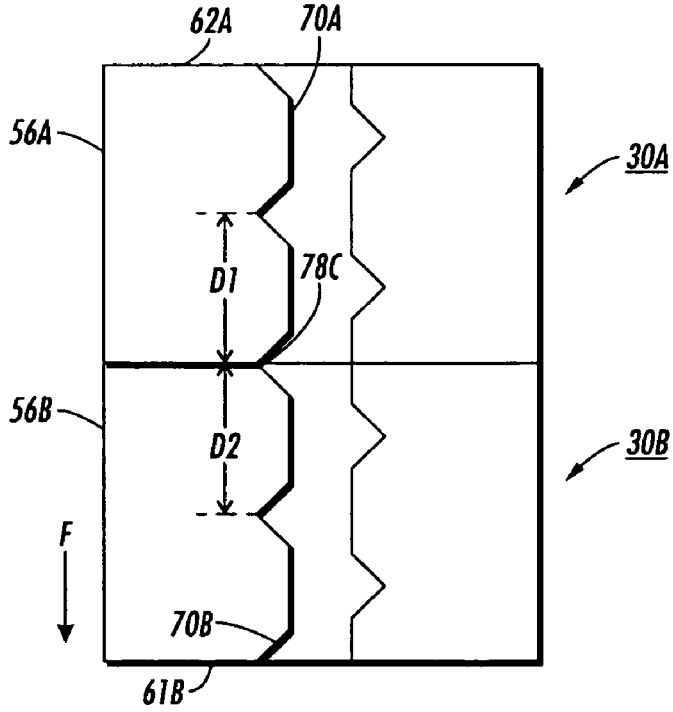
FIG. 11 is another bottom view of an ink stick abutting another ink stick in a feed channel.

Referring to FIGS. 6-9, the first interface track 70 has an actuation distance D that corresponds to the distance between consecutive actuation portions of the interface track. In order to ensure consistency in ink mass consumption sensing, the actuation distance of the first interface track may be the same for all ink sticks that are intended to be used in the same type of phase change printer. The actuation distance between stick transitions, e.g. the distance between the last actuation portion of the first interface track of a first ink stick and the first actuation portion of the first interface track of an adjacent ink stick, can be beneficially the same as the actuation distance between intermediate actuation portions. For instance, as shown in FIG. 10, the distance D1 between actuation portion 78A of ink stick 30A and actuation portion 78B of ink stick 30B is the same as the actuation distance D2 between portion 78B and 78C of ink stick 30B. Care must be taken to ensure that the stick to stick transition relief is not mistaken for an actuation portion of an interface track. This may be accomplished by making the actuation portion of the interface track larger than the stick to stick transition relief. Alternatively, the stick to stick transition relief may be configured to be an actuation portion. For instance, FIG. 11 shows two ink sticks in which the ends of the first interface tracks 70A and 70B are configured to form an actuation portion 78C.

Figure 5:
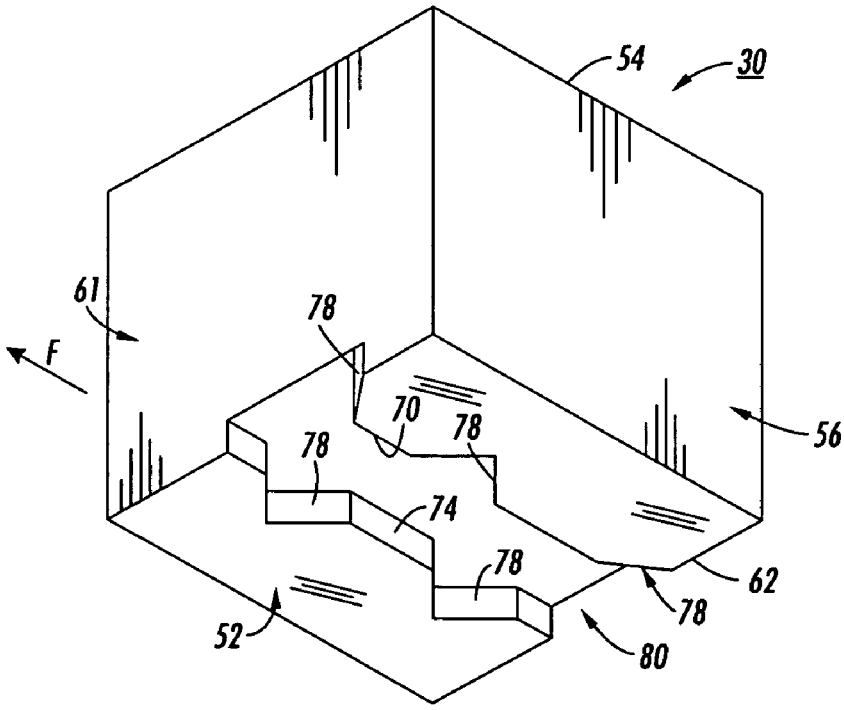
FIG. 5 is a bottom perspective view of another embodiment of the ink stick of FIG. 4.
Figure 6:
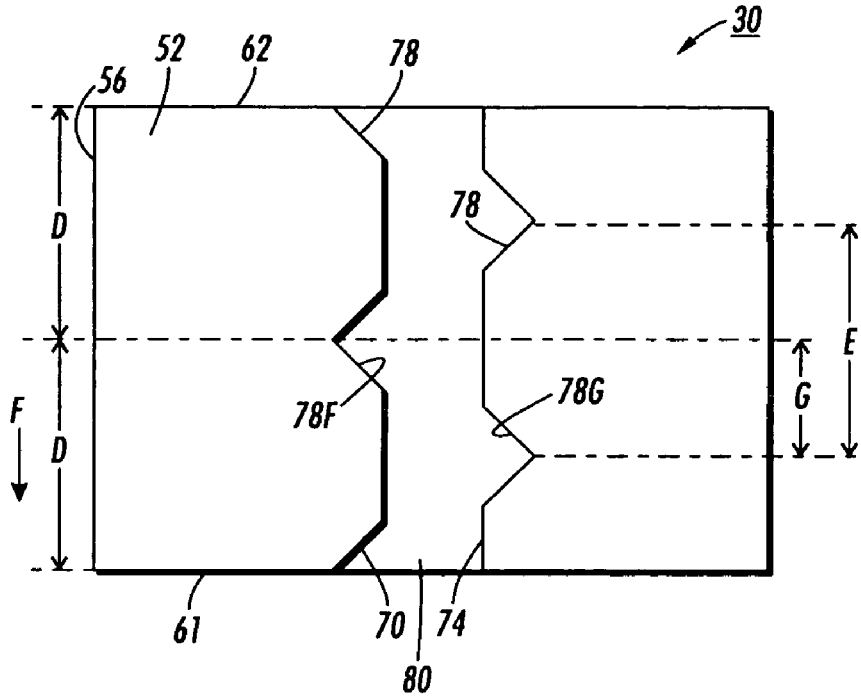
FIG. 6 is a bottom view of the ink stick of FIG. 5.

Referring again to FIGS. 5-9, the ink stick includes a second interface track 74 for interfacing with the sensor system in the ink loader to convey additional variable control information to an imaging device control system. As mentioned above, the interface track 74 includes one or more spaced actuation 78 portions formed along the length of the interface track 74. The second interface track 74 may be formed in any suitable portion of the ink stick. In the embodiment of FIGS. 5-7, the second interface track 74 is formed in the opposite side of the recess from the first interface track. The actuation portions 78 may be of any suitable type depending on the configuration of the sensor system.

The individual actuation portions 78 of the second interface track are configured to actuate one or more sensors of the sensor system in the ink loader to generate a reference signal that corresponds to variable control information pertaining to the ink stick. In one embodiment, the reference signal corresponds to a measured value of the distance E between consecutive actuation portions 78 of the second interface track, or actuation distance E. The actuation distance E of the second interface track 74 may be substantially the same between all of the actuation portions 78 of the second interface track 74.

Thus, in one embodiment, control information may be encoded into the second interface track by varying the actuation distance E of the second interface track 74 to correspond to the control information for that ink stick during manufacturing. For example, a particular interface track may be preselected, or assigned, to indicate a class of control information pertaining to the ink stick, such as, for example, ink consumption, ink stick color, printer compatibility, etc. Specific values or ranges of values that correspond to possible actuation distances of the second interface track may then be assigned to indicate a particular item, or subclass, of control information. Ink sticks may then be manufactured including an interface track with a pre-selected or assigned actuation or with an actuation distance that falls within an assigned range to indicate a particular subclass of information pertaining to the ink stick.

For example, the second interface track 74 of the ink stick in FIG. 6 may be assigned to indicate control information such as color die loading. A particular actuation distance based on the stick length or divisions of the stick length E or range of possible actuation distances may then be assigned to each possible color die loading alternative, such as European color die loading and Asian color die loading. Thus, an ink stick that is intended to have European die loading may be manufactured with a second interface track having an actuation distance that equals or falls within the assigned range of possible actuation distances that correspond to European die loading. A data structure, such as a table, may be created that contains values corresponding to the assigned actuation distance or ranges of actuation distances and the control information, in this case color die loading, to be associated with each value in the table. The data structure may be stored in memory in the printer to be accessed by the printer control system.

The reference signal may be translated by a printer control system into information that may be used in a number of ways by the control system of a printer. For example, the printer control system may compare the reference signal to the data stored in the data structure, or table. The data stored in the data structure may comprise a plurality of possible reference signal values with associated information corresponding to each value. The associated information may comprise control information that pertains to an ink stick. For instance, in one embodiment, the control information comprises ink consumption information. In this embodiment, the interface track conveys, to the control system of a printer, information such as the amount of ink that passes a sensor in the feed channel or the total amount of ink remaining in a feed channel. The control information may also comprise identification/authentication information pertaining to the ink stick, such as, for example, ink stick color, printer compatibility, or ink stick composition information, or may comprise printer calibration information pertaining to the ink stick, such as, for example, suitable color table, thermal settings, etc. that may be used with an ink stick. The ink consumption, identification/authentication and/or printer calibration information may be used by a control system in a suitably equipped phase change ink jet printer to control print operations. For example, the control system may enable or disable operations, optimize operations or influence or set operation parameters based on the "associated information" that corresponds to the index key provided by an interface track.

Alternatively or in addition to the reference signal generated that corresponds to the actuation distance, a reference signal may be generated that corresponds to a measured value of the phase difference G between the first interface track 70 and the second interface track 74. In one embodiment, the phase difference F corresponds to the longitudinal distance between a first actuation portion 78F of the first interface track 70 and the next actuation portion 78G of the second interface that is longitudinally displaced from the first actuation portion 78F of the first interface track 70.

Control information may be encoded into the interface track 74 of an ink stick by varying the phase difference G of the second interface track 74 in relation to the first interface track 70 in the same manner as described above for encoding control information into the actuation distance. As mentioned above, the actuation portions 78 of the first interface track 70 may be consistently placed in a series of ink sticks. Thus, the consistently placed actuation portions 78 of first interface tracks 70 provide a reference point(s) for the placement of the actuation portions 78 of the second interface track 74 such that the value of the phase difference G may be controlled.

The range of variability of the spacing of the actuation portions of the second interface track 74 and the positioning of the actuation portions in relation to the actuation portions of the first interface track 70 allows additional discrimination between ink sticks intended for different imaging devices and increased opportunities for the control system of an imaging device to gain information about the ink sticks that are currently loaded in a feed channel. Additionally, a plurality of interface tracks may be used simultaneously with the first interface track for conveying ink consumption information. Each additional interface track may be assigned to indicate additional variable control information pertaining to the ink stick. Thus, an array of control information may be established for each feed channel by a plurality of reference signals being generated by the plurality of interface tracks providing inputs to the array. (see FIG. 12).

Additionally, interface tracks 70, 74 may be used in combination with keying, orientation and alignment features. This combination of features provides multiple mechanisms for ensuring proper loading of ink sticks and for providing control information pertaining to an ink stick to a printer control system.

Figure 13:
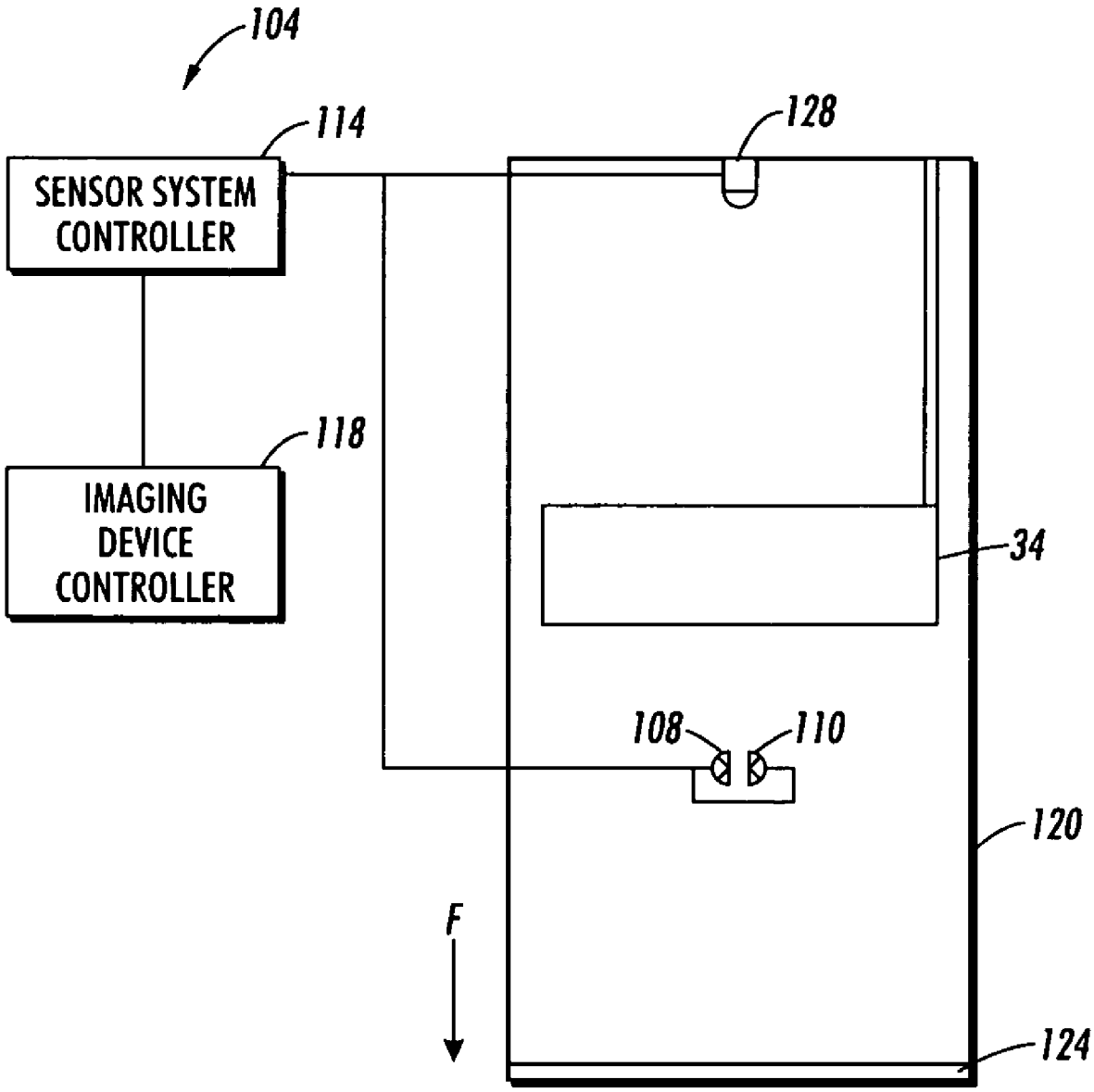
FIG. 13 is a schematic bottom view of a sensor system of an ink loader.

An ink loader may include a sensor system for measuring or detecting the actuation portions of the interface tracks and determining the actuation distances and phase differences of the interface tracks. Referring now to FIG. 13, the sensor system 104 of an ink loader 100 may include a sensor controller 114 in communication with imaging device controller 118 and one or more interface track sensors 108, 110 for sensing the actuation portions 78 of the first and second interface tracks 70, 74 as the ink stick is urged along a feed channel 120 by gravity or a push block 34 toward a melt end 124 of the feed channel 120. The interface track sensors 108, 110 may be optical sensors for optically sensing or detecting the actuation portions, although any suitable detection method may be used. The interface track sensors 108, 110 generate signals in response to each sensing or detection of an actuation portion of the interface tracks as they pass the sensors in the feed channel.

In the embodiment shown, the sensor system includes a first interface track sensor 108 for sensing the actuation portions of the first interface track 70 as they pass the first sensor 108 in the feed channel. The signal generated by sensor 108 in response to sensing actuation portions of the first interface track indicate to the sensor controller 114 and the imaging device controller 118 that a predetermined portion of an ink stick has been consumed with each generation of the signal.

The sensor system includes a second interface track sensor 110 for sensing the actuation portions of the second interface track 74 as they pass the second sensor in the feed channel. The sensor system 104 may be configured to determine the actuation distances of the first and second interface track and the phase difference between the first and second interface track. In one embodiment, the sensor controller 114 is configured to determine distance by monitoring the amount of ink mass consumed, or the amount of ink ejected from the print head, and correlating the ink mass consumed to a distance along the ink stick. Mass tracking in this fashion may include some inaccuracies due to system tolerances and drift, as described previously. As long as the resolution between possible actuation distances that may be incorporated into the second interface track correspond to various ink configurations or shop keeping units (SKU's), identification of various ink SKU's can be established. Accurate ink stick sensing transitions serve to keep this tolerance window small by allowing more frequent mass consumption drift calibrations. An ink stick sensor interface track is defined as the path a sensor component establishes as an ink stick is fed past it and may include a full length inset track or notch or a notched sensor interaction portion of the travel path that also includes some length of the outer periphery of the ink stick body. The sensor track need not be a full length recess to provide various SKU differentiation and ink parameter information.

In an alternative embodiment, the sensor system may include a distance sensor 128 for determining the distance that the ink stick travels along the feed channel by sensing the position of the push block 34 in the feed channel 120. The distance may be sensed optically or mechanically. In this embodiment, the actuation distance of an interface track may be determined by detecting the distance that the push block travels between actuation of a single interface track sensor. The phase difference may be determined by detecting the distance the push block travels along the feed channel between consecutive actuations of the first and second interface track sensors.

The interface track sensors 108, 110 may be positioned in any suitable location in the feed channel 120 depending on the location of the interface tracks on an ink stick. For example, in the embodiment of FIG. 13, the interface track sensors 108, 110 are positioned adjacent the bottom of the feed channel for sensing the interface tracks of the ink stick of FIGS. 5-7 which are positioned in a recess on the bottom surface of the ink stick.

Figure 14:
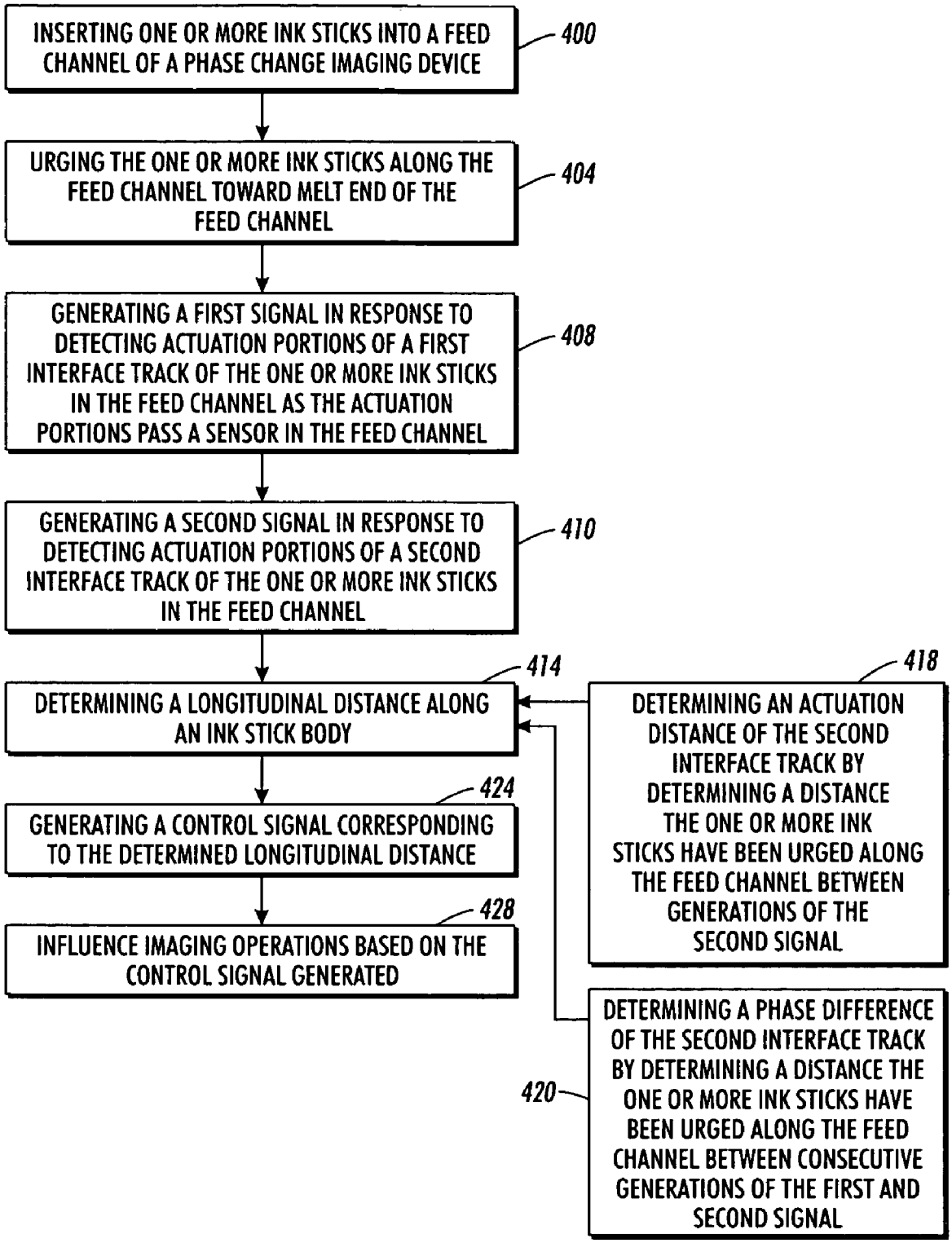
FIG. 14 is a flowchart for a method of feeding solid ink sticks in a feed channel of an ink loader.

FIG. 14 is a flowchart outlining an exemplary embodiment of a method of feeding ink sticks in an ink loader of a phase change imaging device. The method comprises inserting one or more ink sticks into a feed channel of a phase change imaging device (block 400) and urging the one or more ink sticks along the feed channel toward the melt end of the feed channel (block 404). As the ink sticks are being urged along the feed channel, a first signal is generated in response to detecting actuation portions of a first interface track of the one or more ink sticks in the feed channel as the actuation portions pass a first sensor in the feed channel (block 408). The first signal indicates to a printer control system that a predetermined amount of ink mass has been consumed. A second signal is generated in response to detecting actuation portions of a second interface track of the one or more ink sticks in the feed channel as the actuation portions pass a second sensor in the feed channel (block 410). A distance the one or more ink sticks have been urged along the feed channel between generations of the first or second signals is then determined (block 414).

In one embodiment, the distance determined is the distance the ink sticks have been urged along the feed channel between generations of the second signal (block 418). The distance the ink sticks have been urged along the feed channel between generations of the second signal corresponds to an actuation distance, the actuation distance being sized to correspond to variable control information pertaining to the one or more ink sticks in the feed channel. In another embodiment, the distance determined is the distance the ink sticks have been urged along the feed channel between consecutive generations of the first and second signal (block 420). The distance the ink sticks have been urged along the feed channel between consecutive generations of the first and second signal corresponds to a phase difference of the first and second interface tracks of the one or more ink sticks, the phase difference being varied to correspond to variable control information pertaining to the one or more ink sticks in the feed channel. A control signal may then be generated that corresponds to the measured actuation distance and/or phase difference (block 424). The printer control system may then influence imaging operations based on the control information indicated by the phase difference (block 428).

In one embodiment, the control information indicated by the actuation distance or phase difference may comprise identification information pertaining to the ink sticks such as color, ink formulation, etc. In this embodiment, influencing imaging operations may comprise halting operations if the identification information indicates that the ink stick is not compatible with the imaging device or if the ink sticks are the wrong color for the feed channel. In another embodiment, the control information indicated may comprise imaging device calibration information such as color table, marketing requirements, etc. In this embodiment, influencing imaging operations may comprise setting imaging operations based on the imaging device calibration information.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An ink stick for use in an ink loader of an imaging device, the ink stick comprising:

a three dimensional ink stick body configured to fit within a feed channel of the imaging device, the ink stick body having an exterior surface; and a first interface track formed in the exterior surface from a leading end to a trailing end of the ink stick body parallel to a feed direction of the ink loader, the first interface track including one or more actuation portions for actuating a first sensor in the feed channel to generate a first signal as the one or more actuation portions pass the sensor in the feed channel; and a second interface track formed in the exterior surface from the leading end to the trailing end of the ink stick body parallel to the first interface track, the second interface track including one or more actuation portions for actuating a second sensor in the feed channel to generate a second signal as the actuation portions pass the second sensor in the feed channel.

2. The ink stick of claim 1, wherein the first signal actuated by the actuation portions indicates that a predetermined amount of ink mass of the ink stick body has been consumed, the predetermined amount of ink being substantially the same between each actuation portion of the first interface track.

3. The ink stick of claim 1, wherein the second interface track has an actuation distance corresponding to a distance between actuation portions of the second interface track; and wherein the actuation distance of the second interface track corresponds to variable control information pertaining to the ink stick.

4. The ink stick of claim 3, wherein the second interface track has a phase difference corresponding to a distance between an actuation portion of the first interface track and a next successive actuation portion of the second interface track in a longitudinal direction; and wherein the phase difference of the second interface track is sized to correspond to additional variable control information pertaining to an ink stick.

5. The ink stick of claim 3, wherein the variable control information comprises identification information pertaining to the ink stick.

6. The ink stick of claim 3, wherein the variable control information comprises imaging device calibration information pertaining to the ink stick.

7. The ink stick of claim 3, wherein the variable control information comprises market pricing information pertaining to the ink stick.

8. A solid ink loader for use with a phase change imaging device, the ink loader comprising:

a push block for contacting and urging an ink stick along a feed channel;

a first sensor for detecting actuation portions of a first interface track of an ink stick and generating a first signal in response to the detecting of the actuation portions;

a second sensor for sensing actuation portions of a second interface track of an ink stick and generating a second signal in response to the detecting of the actuation portions.

9. The ink loader of claim 8, wherein each generation of the first signal indicates that a predetermined amount of ink mass of an ink stick has been consumed.

10. The ink loader of claim 8, further comprising:

a distance sensor configured to measure a longitudinal distance between actuation portions of the second interface track, the distance between actuation portions corresponding to an actuation distance.

11. The ink loader of claim 10, wherein the distance sensor is configured to measure a longitudinal distance between an actuation portion of the first interface track and a next successive actuation portion of the second interface track, the distance between actuation portions corresponding to a phase difference.

12. The ink loader of claim 10, wherein the distance sensor is configured to generate a control signal that corresponds to the measured distance.

13. The ink loader of claim 12, wherein the control signal indicates ink stick identification information to an imaging device control system.

14. The ink loader of claim 12, wherein the control signal indicates imaging device calibration information to an imaging device control system.

15. The ink loader of claim 8, further comprising:

a distance sensor configured to measure a longitudinal distance along an ink stick body in the feed channel by determining a distance the push block has urged an ink stick along the feed channel between generations of the first or second signals.

16. A method of feeding ink sticks in an ink loader of a phase change imaging device, the method comprising:

inserting one or more ink sticks into a feed channel of a phase change imaging device;

urging the one or more ink sticks along the feed channel toward the melt end of the feed channel;

generating a first signal in response to detecting actuation portions of a first interface track of the one or more ink sticks in the feed channel as the actuation portions pass a sensor in the feed channel, the first signal indicating that a predetermined amount of ink mass has been consumed; and generating a second signal in response to detecting actuation portions of a second interface track of the one or more ink sticks in the feed channel.

17. The method of claim 16, further comprising:

determining a longitudinal distance along an ink stick body; and generating a control signal corresponding to the determined longitudinal distance.

18. The method of claim 17, wherein the determination of the longitudinal distance comprises:

determining an actuation distance of the second interface track by determining a distance the one or more ink sticks have been urged along the feed channel between generations of the second signal.

19. The method of claim 17, wherein the determination of the longitudinal distance comprises:

determining a phase difference of the second interface track by determining a distance the one or more ink sticks have been urged along the feed channel between consecutive generations of the first and second signal.

20. The method of claim 17, further comprising:

setting operation parameters for imaging operations in accordance with the generated control signal.

21. An ink stick for use in an ink loader of an imaging device, the ink stick comprising:

a solid ink stick body configured for movement through an ink loader of a phase change ink imaging device, the ink stick body including:

an exterior surface;

a first interface track and a second interface track, each interface track being formed in the exterior surface from a leading end to a trailing end of the ink stick body substantially parallel to a feed direction of the ink loader, the first and second interface tracks each including at least one actuation portion for actuating at least one sensor in the ink loader to generate signals; and a difference between the at least one actuation portion of the first interface track and the at least one actuation portion of the second interface track defining a phase difference that corresponds to information pertaining to the ink stick.

22. The ink stick of claim 21, the least one actuation portion of the first interface track being configured to generate a first signal, the first signal indicating consumption of a portion of the ink mass of the ink stick body.

23. The ink stick of claim 22, the second interface track further comprising:

at least two actuation portions; and an actuation distance between the at least two actuation portions of the second interface track, the actuation distance between the at least two actuation portions of the second interface track corresponding to variable control information pertaining to the ink stick.

24. The ink stick of claim 23, each of the at least two actuation portions of the second interface track being configured to generate a second signal, a difference between generations of the second signal indicating the actuation distance of the second interface track.

25. The ink stick of claim 23, the variable control information comprising identification information pertaining to the ink stick.

26. The ink stick of claim 23, the variable control information comprising imaging device calibration information pertaining to the ink stick.

* * * * *